US008779271B2

(12) United States Patent
Abe et al.

(10) Patent No.: US 8,779,271 B2
(45) Date of Patent: Jul. 15, 2014

(54) TONAL COMPONENT DETECTION METHOD, TONAL COMPONENT DETECTION APPARATUS, AND PROGRAM

(71) Applicant: Sony Corporation, Tokyo (JP)

(72) Inventors: Mototsugu Abe, Kanagawa (JP); Masayuki Nishiguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/780,179

(22) Filed: Feb. 28, 2013

(65) Prior Publication Data

US 2013/0255473 A1 Oct. 3, 2013

(30) Foreign Application Priority Data

Mar. 29, 2012 (JP) ..... 2012-078320

(51) Int. Cl.
*G10H 1/06* (2006.01)

(52) U.S. Cl.
USPC ..... 84/616; 84/654

(58) Field of Classification Search
USPC ..... 84/616, 656
See application file for complete search history.

(56) References Cited

U.S. PATENT DOCUMENTS

| | | | | |
|---|---|---|---|---|
| 5,229,716 | A * | 7/1993 | Demoment et al. | 324/307 |
| 6,542,869 | B1 * | 4/2003 | Foote | 704/500 |
| 6,604,072 | B2 * | 8/2003 | Pitman et al. | 704/231 |
| 7,276,656 | B2 * | 10/2007 | Wang | 84/612 |
| 7,598,447 | B2 * | 10/2009 | Walker et al. | 84/616 |
| 7,627,477 | B2 * | 12/2009 | Wang et al. | 704/273 |
| 7,978,862 | B2 * | 7/2011 | Betts | 381/94.4 |
| 8,116,463 | B2 * | 2/2012 | Wang | 381/56 |
| 8,255,214 | B2 * | 8/2012 | Abe et al. | 704/231 |
| 8,315,857 | B2 * | 11/2012 | Klein et al. | 704/211 |
| 8,588,427 | B2 * | 11/2013 | Uhle et al. | 381/17 |
| 2002/0138795 | A1 * | 9/2002 | Wang | 714/707 |
| 2002/0143530 | A1 * | 10/2002 | Pitman et al. | 704/231 |
| 2002/0181711 | A1 * | 12/2002 | Logan et al. | 381/1 |
| 2004/0165736 | A1 * | 8/2004 | Hetherington et al. | 381/94.3 |
| 2004/0211260 | A1 * | 10/2004 | Girmonsky et al. | 73/579 |
| 2004/0260540 | A1 * | 12/2004 | Zhang | 704/205 |
| 2005/0177372 | A1 * | 8/2005 | Wang et al. | 704/273 |
| 2006/0095254 | A1 * | 5/2006 | Walker et al. | 704/207 |
| 2006/0229878 | A1 * | 10/2006 | Scheirer | 704/273 |
| 2007/0010999 | A1 * | 1/2007 | Klein et al. | 704/211 |
| 2008/0133223 | A1 * | 6/2008 | Son et al. | 704/200.1 |
| 2008/0148924 | A1 * | 6/2008 | Tsui et al. | 84/618 |
| 2009/0125298 | A1 * | 5/2009 | Master et al. | 704/200.1 |
| 2009/0265174 | A9 * | 10/2009 | Wang et al. | 704/273 |

(Continued)

OTHER PUBLICATIONS

McAulay, R.J., et al. "Speech Analysis/Synthesis Based on Sinusoidal Representation" IEEE Transactions on Acoustics, Speech and Signal Processing, Aug. 4, 1986, pp. 744-754.

(Continued)

*Primary Examiner* — Elvin Enad
(74) *Attorney, Agent, or Firm* — Wolf, Greenfield & Sacks, P.C.

(57) ABSTRACT

There is provided a tonal component detection method including performing a time-frequency transformation on an input time signal to obtain a time-frequency distribution, detecting a peak in a frequency direction at a time frame of the time-frequency distribution, fitting a tone model in a neighboring region of the detected peak, and obtaining a score indicating tonal component likeness of the detected peak based on a result obtained by the fitting.

11 Claims, 11 Drawing Sheets

(56) References Cited

U.S. PATENT DOCUMENTS

| | | | | |
|---|---|---|---|---|
| 2009/0282966 | A1* | 11/2009 | Walker et al. | 84/616 |
| 2010/0000395 | A1* | 1/2010 | Walker et al. | 84/616 |
| 2011/0015931 | A1* | 1/2011 | Kawahara et al. | 704/264 |
| 2011/0071824 | A1* | 3/2011 | Espy-Wilson et al. | 704/233 |
| 2011/0123044 | A1* | 5/2011 | Hetherington et al. | 381/94.2 |
| 2011/0194702 | A1* | 8/2011 | Wang | 381/17 |
| 2011/0235823 | A1* | 9/2011 | Betts | 381/94.4 |
| 2011/0243349 | A1* | 10/2011 | Zavarehei | 381/94.1 |
| 2012/0046771 | A1* | 2/2012 | Abe et al. | 700/94 |
| 2012/0067196 | A1* | 3/2012 | Rao et al. | 84/611 |
| 2012/0103166 | A1* | 5/2012 | Shibuya et al. | 84/616 |
| 2012/0157857 | A1* | 6/2012 | Abe et al. | 600/484 |
| 2012/0197420 | A1* | 8/2012 | Kumakura et al. | 700/94 |
| 2012/0243705 | A1* | 9/2012 | Bradley et al. | 381/94.4 |
| 2012/0266742 | A1* | 10/2012 | Touyama et al. | 84/659 |
| 2012/0266743 | A1* | 10/2012 | Shibuya et al. | 84/659 |
| 2013/0255473 | A1* | 10/2013 | Abe et al. | 84/605 |
| 2013/0282373 | A1* | 10/2013 | Visser et al. | 704/233 |

OTHER PUBLICATIONS

Smith, Julius O., et al. "Parshl: An Analysis/Synthesis Program for Non-Harmonic Sounds Based on Sinusoidal Representation" Center for Computer Research in Music and Acoustics, Department of Music, Stanford University, Stanford, CA, 1987, pp. 1-23.

* cited by examiner

TONAL COMPONENT DETECTION METHOD, TONAL COMPONENT DETECTION APPARATUS, AND PROGRAM

BACKGROUND

The present technology relates to a tonal component detection method, a tonal component detection apparatus, and a program.

Components constituting a one-dimensional time signal such as voice or music are broadly classified into three types of representations: (1) a tonal component, (2) a stationary noise component, and (3) a transient noise component. The tonal component corresponds to a component caused by the stationary and periodic vibration of a sound source. The stationary noise component corresponds to a component caused by a stationary but non-periodic phenomenon such as friction or turbulence. The transient noise component corresponds to a component caused by a non-stationary phenomenon such as a blow or a sudden change in a sound condition. Among them, the tonal component is a component that faithfully represents the intrinsic properties of a sound source itself, and thus it is particularly important when analyzing the sound.

The tonal component obtainable from an actual sound may often be a plurality of sinusoidal components which are gradually changed over time. The tonal component may be represented, for example, as a horizontal stripe-shaped pattern on a spectrogram representing amplitudes of the short-time Fourier transform with a time series, as shown in FIG. 8. FIG. 9 illustrates a spectrum in which frames in the vicinity of 0.2 seconds on the time axis in FIG. 8 are extracted. In FIG. 9, true tonal components to be detected for reference are indicated by directional arrows. The high-accuracy detection of the time and frequency in which the tonal components are present from such a spectrum becomes a fundamental process for many application techniques such as sound analysis, coding, noise reduction, and high-quality sound reproduction.

The detection of tonal components has been made from the past. A typical technique of detecting tonal components includes a method of obtaining an amplitude spectrum at each of the short time frames, detecting local peaks of the amplitude spectrum, and regarding all of the detected peaks as tonal components. One disadvantage of this method is that a large number of erroneous detections are made, because none of the local peaks becomes necessarily tonal components.

Incidentally, local peaks occurred in the amplitude spectrum includes (1) a peak due to the tonal component, (2) a side lobe peak, (3) a noise peak, and (4) an interference peak. FIG. 10 shows results obtained by detecting local peaks in amplitude spectrum on the spectrogram of FIG. 8 and the results are indicated by black dots. It will be found that the black horizontal stripes, i.e. tonal components shown in FIG. 8 are detected in the form of a horizontal line shape in FIG. 10 as well. However, on the other hand, it will be found that a large number of peaks are also detected from portions such as noise components. FIG. 11 shows results obtained by similarly detecting local peaks based on the spectrum of FIG. 9, and the results are indicated by black dots. It will be found that there are a large number of erroneously detected peaks in FIG. 11 as compared to accurately detected tonal components in FIG. 9.

For the method described above, an approach for improving the detection accuracy may include, for example, (A) method of setting a threshold for the height of each local peak and then not detecting local peaks having a smaller value than the threshold, and (B) method of connecting local peaks across multiple frames in a time direction according to the local neighbor rule and then excluding components which are not connected more than a certain number of times.

The method of (A) is assumed that the magnitude of tonal components is greater than that of noise components at all times. However, this assumption is unreasonable and is not true in many cases, thus its performance improvement will be limited. Actually, the magnitude of the peak erroneously detected in the vicinity of 2 kHz on the frequency axis of FIG. 11 is almost the same as that of the tonal component in the vicinity of 3.9 kHz, thus this assumption is not true.

The method of (B) is disclosed in, for example, R. J. McAulay and T. F. Quatieri: "Speech Analysis/Synthesis Based on a Sinusoidal Representation," IEEE Transactions on Acoustics, Speech and Signal Processing, Vol. 34, No. 4, 744/754 (August 1986), and J. O. Smith III and X. Serra, "PARSHL: An Analysis/Synthesis Program for Non-Harmonic Sounds Based on a Sinusoidal Representation", Proceedings of the International Computer Music Conference (1987). This method employs a property that tonal components have temporal continuity (e.g., in case of music, a tonal component is often continued for a period of time more than 100 ms). However, because peaks in any other components than the tonal components may be continued and a shortly segmented tonal component is not detected, it is not necessarily mean that sufficient accuracy can be achieved in many applications.

SUMMARY

According to an embodiment of the present technology, it is possible to accurately detect a tonal component from time signals such as voice or music.

According to an embodiment of the present technology, there is provided a tonal component detection method including performing a time-frequency transformation on an input time signal to obtain a time-frequency distribution, detecting a peak in a frequency direction at a time frame of the time-frequency distribution, fitting a tone model in a neighboring region of the detected peak, and obtaining a score indicating tonal component likeness of the detected peak based on a result obtained by the fitting.

According to the embodiments of the present technology described above, in the step of performing the time-frequency transformation, the time-frequency distribution (spectrogram) can be obtained by performing the time-frequency transformation on the input time signal. In this case, for example, the time-frequency transformation of the input time signal may be performed using a short-time Fourier transform. In addition, the time-frequency transformation of the input time signal may be performed using other transformation techniques such as a wavelet transform.

In the step of detecting the peak, the peak of the frequency direction is detected at each of the time frames in the time-frequency distribution. In the step of fitting, the tone model is fitted in a neighboring region of each of the detected peaks. In this case, for example, a quadratic polynomial function in which a time and a frequency are set to variables may be used as the tone model. In addition, a cubic or higher-order polynomial function may be used. Further, in this case, the fitting may be performed, for example, based on a least square error criterion of the tone model and a time-frequency distribution in the vicinity of each of the detected peaks. In addition, the fitting may be performed based on a minimum fourth-power error criterion, a minimum entropy criterion, and so on.

A score indicating tonal component likeness of the detected peak may be obtained based on a result obtained by the fitting. In this case, in the step of obtaining the score, for example, the score indicating the tonal component likeness of the detected peak may be obtained using at least a fitting error extracted based on the result obtained by the fitting. Further, in this case, in the step of obtaining the score, for example, the score indicating the tonal component likeness of the detected peak may be obtained using at least a peak curvature in a frequency direction extracted based on the result obtained by the fitting.

Further, in this case, in the step of obtaining the score, for example, the score indicating the tonal component likeness of the detected peak may be obtained by extracting a predetermined number of features and by combining the predetermined number of extracted features, based on the result obtained by the fitting. In this case, in the step of obtaining the score, when the predetermined number of extracted features are combined, a non-linear function may be applied to the predetermined number of extracted features to obtain a weighted sum. The predetermined number of features may be at least one of a fitting error, a peak curvature in a frequency direction, a frequency of a peak, an amplitude value in a peak position, a rate of a change in a frequency, or a rate of a change in amplitude that are obtained by the tone model on which the fitting is performed.

According to the embodiments of the present technology as described above, the tone model can be fitted in a neighboring region of each peak in the frequency direction detected from the time-frequency distribution (spectrogram), and the score indicating the tonal component likeness of each of the detected peaks can be obtained based on results obtained by the fitting. Therefore, it is possible to accurately detect tonal components.

According to embodiments of the present technology, it is possible to accurately detect a tonal component from time signals such as voice or music.

DETAILED DESCRIPTION OF THE EMBODIMENT(S)

Figure 1:
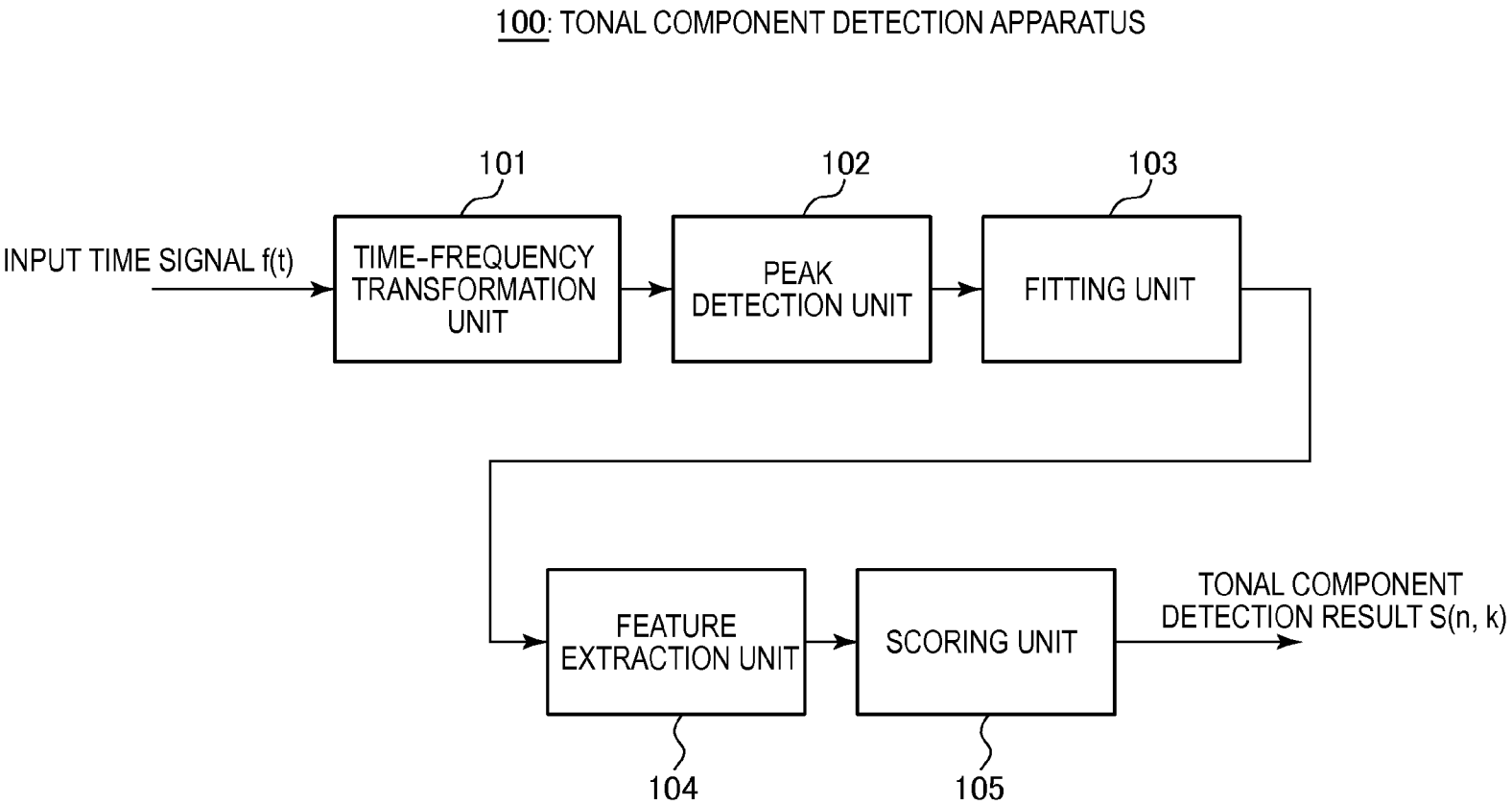
FIG. 1 is a block diagram illustrating an exemplary configuration of a tonal component detection apparatus according to an embodiment of the present technology.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

1. Embodiment
2. Modification

1. Embodiment

[Tonal Component Detection Apparatus]

FIG. 1 illustrates an exemplary configuration of a tonal component detection apparatus 100. The tonal component detection apparatus 100 includes a time-frequency transformation unit 101, a peak detection unit 102, a fitting unit 103, a feature extraction unit 104, and a scoring unit 105.

The time-frequency transformation unit 101 transforms an input time signal f(t) such as voice or music into a time-frequency representation to obtain a time-frequency signal F(n,k). In this example, t is the discrete time, n is the time frame number, and k is the discrete frequency. The time-frequency conversion unit 101 obtains the time-frequency signal F(n,k) by transforming the input time signal f(t) into a time-frequency representation, for example, using a short-time Fourier transform, as given in the following Equation (1).

$$F(n,k) = \log\left|\sum_{t=0}^{M-1} W(t)f(t-nR)e^{j2\pi kn}\right| \tag{1}$$

In the above Equation (1), W(t) is the window function, M is the size of the window function, and R is the frame time interval (hop size). The time-frequency signal F(n,k) indicates a logarithmic amplitude value of the frequency component in the time frame n and frequency k, i.e., it is a spectrogram (time-frequency distribution).

The peak detection unit 102 detects peaks in the frequency direction at each time frame of the spectrogram obtained by the time-frequency transformation unit 101. Specifically, the peak detection unit 102 detects whether peaks (maximum values) are found in the frequency direction for all of the frames and all of the frequencies on the spectrogram.

The detection of whether F(n,k) is a peak or not is performed by checking whether the following Equation (2) is satisfied. In addition, as the method of detecting peaks, a method of using three points is illustrated, but a method of using five points may be used.

$$F(n,k-1)<F(n,k) \text{ and } F(n,k)>F(n,k+1) \tag{2}$$

The fitting unit 103 fits a tone model in a neighboring region of each of the peaks detected by the peak detection unit 102, as described below. The fitting unit 103 initially performs a coordinate transformation into a coordinate with a target peak as the origin and then sets up a neighboring time-frequency region as given in the following Equation (3).

In Equation (3), $\Delta_N$ is the neighboring region in the time direction (e.g., three points), and $\Delta_k$ is the neighboring region in the frequency direction (e.g., two points).

$$\Gamma=[-\Delta_N\le n\le\Delta_N]\times[-\Delta_K\le k\le\Delta_K] \tag{3}$$

Subsequently, the fitting unit 103 fits, for example, a tone model of the quadratic polynomial function as given in the following Equation (4), with respect to the time-frequency signal within the neighboring region. In this case, the fitting unit 103 performs the fitting, for example, based on the least square error criterion of the tone model and the time-frequency distribution in the vicinity of the peak.

$$Y(k,n)=ak^2+bk+ckn+dn^2+en+g \tag{4}$$

In other words, the fitting unit 103 performs the fitting by obtaining coefficients that minimize the square error as given in the following Equation (5), in the neighboring region of the time-frequency signal and the polynomial function. The coefficients are determined as given in the following Equation (6).

$$J(a, b, c, d, e, g) = \sum_{\Gamma} (Y(k, n) - F(k, n))^2 \tag{5}$$

$$(\hat{a}, \hat{b}, \hat{c}, \hat{d}, \hat{e}, \hat{g}) = \operatorname{argmin} J(a, b, c, d, e, g) \tag{6}$$

Figure 2:
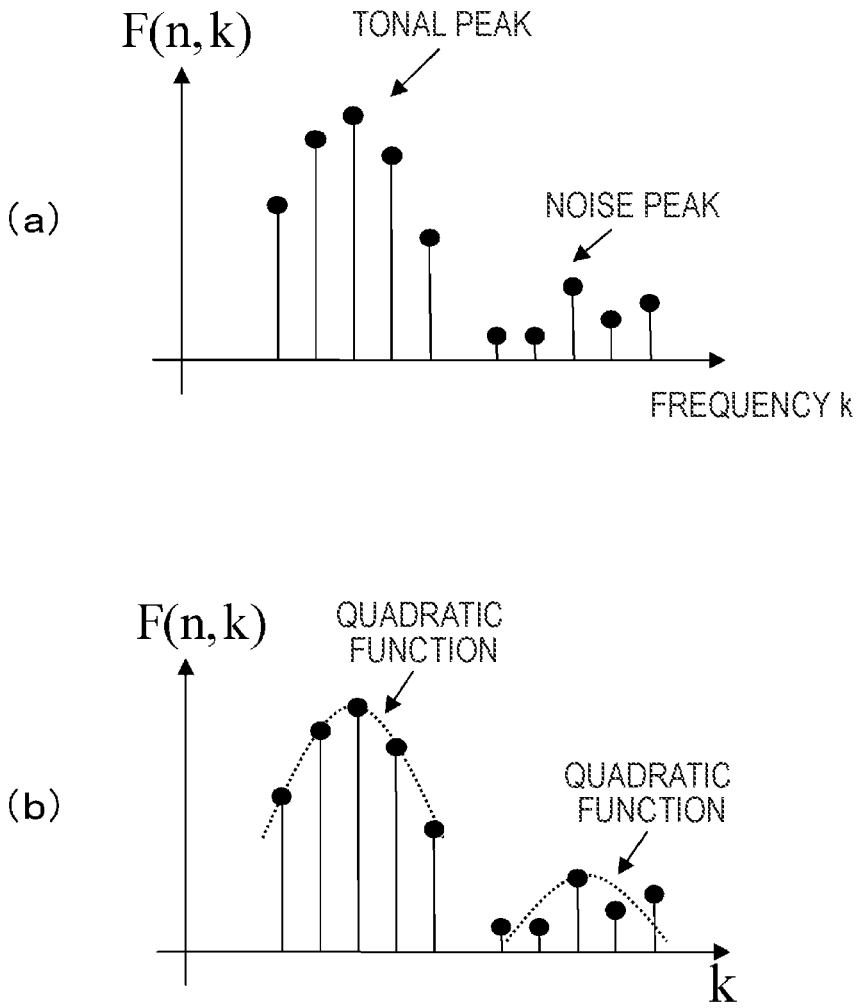
FIG. 2 is a schematic diagram for explaining the property that a quadratic polynomial function is well fitted in the vicinity of a tonal spectral peak but it is not well fitted in the vicinity of a noise spectral peak.

This quadratic polynomial function has the property that it is well fitted in the vicinity of the tonal spectral peak (smaller margin of error) but it is not well fitted in the vicinity of the noise spectral peak (larger margin of error). This property of the function is schematically shown in FIG. 2(*a*) and FIG. 2(*b*). FIG. 2(*a*) schematically shows the spectrum in the vicinity of the tonal peak of the n-th frame obtained from the above Equation (1).

FIG. 2(*b*) shows how the quadratic function $f_0(k)$ which is given in the following Equation (7) is fitted to the spectrum shown in FIG. 2(*a*). In the following Equation (7), a is the peak curvature, $k_0$ is the true peak frequency, and $g_0$ is the logarithm amplitude value at a true peak position. The quadratic function is well fitted to the tonal component spectral peak, but the margin of error tends to be large in the noise peaks.

$$f_0(k)=a(k-k_0)^2+g_0 \tag{7}$$

Figure 3:
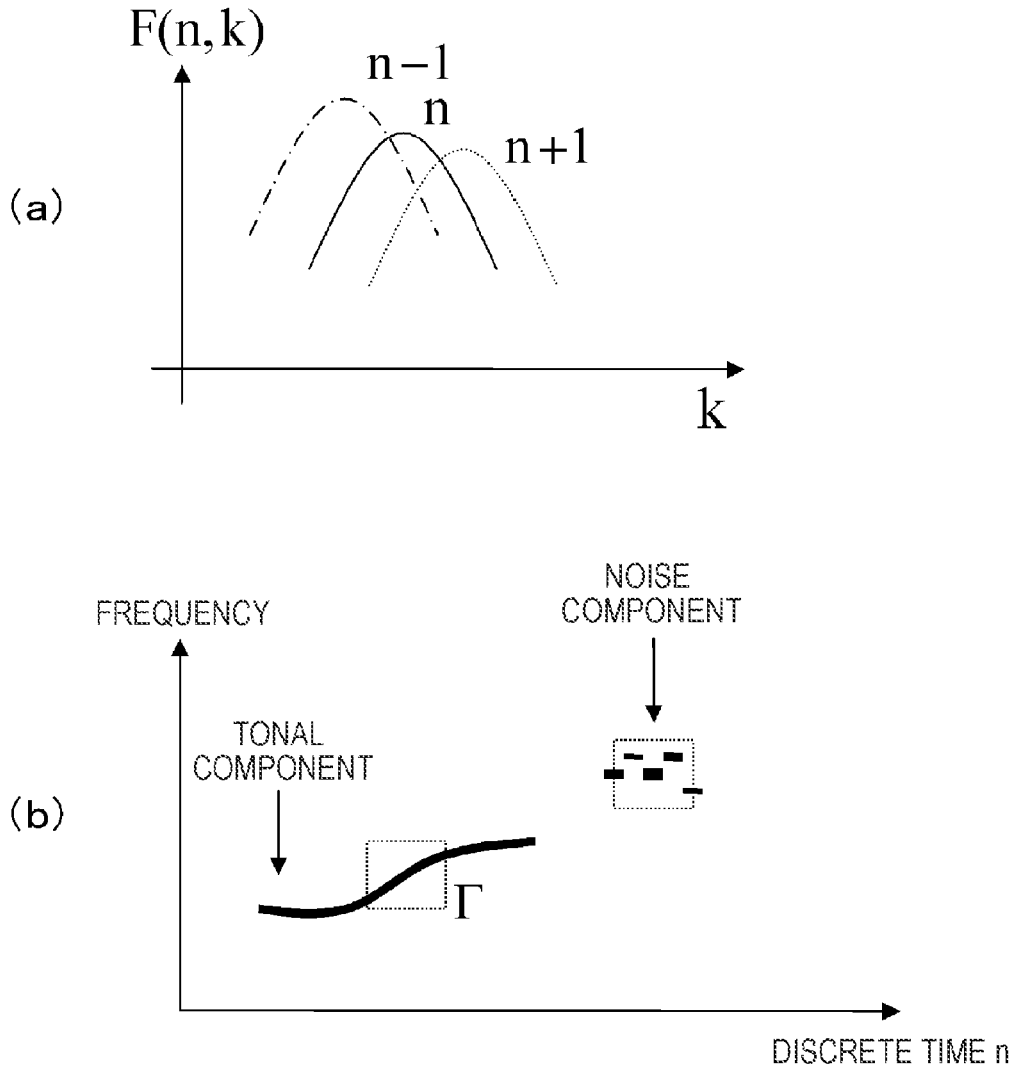
FIG. 3 is a schematic diagram illustrating the change of tonal peaks in the time direction and the fitting performed in a small region F on the spectrogram.

FIG. 3(*a*) schematically shows the change of the tonal peaks in the time direction. The tonal peak has the amplitude and frequency that are being changed while maintaining its overall shape in the previous and subsequent time frames. In addition, the obtained spectrum is actually formed by discrete points, but the spectrum is drawn with a curved line in the figure for descriptive purposes. Specifically, the dashed line represents the previous frames, the solid line represents the current frames, and the dotted line represents the subsequent frames.

In many cases, the tonal components have a certain extent of time continuity and involve some changes in frequency and time, but the tonal components can be represented by the shift of substantially the same form of quadratic function. This change Y(k,n) is given by the following Equation (8). The spectrum is represented by logarithmic amplitudes, and thus the amplitudes are changed between the top and bottom of the spectrum. This is the reason why the addition of the term $f_1(n)$ indicating the change in amplitude is necessary. In the following Equation (8), β is the rate of change in amplitude, and $f_1(n)$ is the time function indicating the change in amplitude at the peak position.

$$Y(k,n)=f_0(k-\beta n)+f_1(n) \tag{8}$$

If $f_1(n)$ is approximated by the quadratic function in the time direction, the change Y(k,n) is given by the following Equation (9). In Equation (9), a, $k_0$, β, $d_1$, $e_1$, and $g_0$ are constants, and thus Equation (9) will be equivalent to Equation (8) by converting them to appropriate variables.

$$\begin{aligned} Y(k, n) &= a(k - k_0 - \beta n)^2 + g_0 + d_1 n^2 + e_1 n \\ &= ak^2 - 2ak_0k - 2ak_0kn + a\beta^2 n^2 + d_1 n^2 + \\ &\quad 2ak_0\beta n + e_1 n + ak_0^2 + g_0 \end{aligned} \tag{9}$$

FIG. 3(*b*) schematically shows a fitting performed in the small region Γ on the spectrogram. Equation (4) tends to be well fitted for the tonal component, because the tonal peaks with a similar shape are gradually changed over time. However, the shape or frequency of the peaks are varied in the vicinity of the noise peaks, and then Equation (4) is not well fitted. In other words, even when the fitting is performed optimally, the error becomes large.

Furthermore, Equation (6) shows the calculation in which the fitting is performed for all of the coefficients a, b, c, d, e, and g. However, some of the coefficients may be previously fixed to the constant values and the fitting may be performed on them. In addition, the fitting may be performed using the quadratic and higher order polynomial function.

Referring back to FIG. 1, the feature extraction unit 104 extracts the features ($x_0$, $x_1$, $x_2$, $x_3$, $x_4$, $x_5$) as given in the following Equation (10) based on the results (see Equation (6)) obtained by fitting each of the peaks in the fitting unit 103. Each of the features indicates the property of frequency component in each peak and it can be used in analyzing a voice, music, or the like without any modification.

$$\left.\begin{array}{ll} \text{[Curvature of peak]} & x_0 = \hat{a} \\ \text{[Frequency of peak]} & x_1 = -\dfrac{\hat{b}}{2\hat{a}} \\ \text{[Logarithmic amplitude value of peak]} & x_2 = \hat{g} \\ \text{[Rate of change in frequency]} & x_3 = -\dfrac{\hat{c}}{2\hat{a}} \\ \text{[Rate of change in amplitude]} & x_4 = \hat{e} \\ \text{[Fitting normalization error]} & x_5 = \dfrac{J(\hat{a}, \hat{b}, \hat{c}, \hat{d}, \hat{e}, \hat{g})}{\sum_{\Gamma} (F(k, n) - \hat{g})^2} \end{array}\right\} \tag{10}$$

The scoring unit 105 obtains scores indicating the tonal component likeness of each peak using the features extracted by the feature extraction unit 104 for each peak in order to quantify the tonal component likeness of each peak. The scoring unit 105 obtains the score S(n,k) as given in the following Equation (11) using one or a plurality of features ($x_0$, $x_1$, $x_2$, $x_3$, $x_4$, $x_5$). In this case, at least the fitting normalization error $x_5$ or the peak curvature $x_0$ in the frequency direction is used.

$$S(n, k) = \operatorname{Sigm}\left(\sum_{i=0}^{5} w_i H_i(x_i) + w_6\right) \tag{11}$$

In Equation (11), Sigm(x) is the sigmoid function, $w_i$ is the predetermined weighting factor, $H_i(x_i)$ is the predetermined non-linear function performed for the i-th feature $x_i$. For example, the function as given in the following Equation (12) can be used as the non-linear function $H_i(x_i)$. In Equation (12), $u_i$ and $v_i$ are the predetermined weighting factors. In addition, $w_i$, $u_i$, and $v_i$ may be previously set to any suitable constants, or alternatively, they may be automatically determined by performing the steepest decent learning procedure or the like using a large amount of data.

$$H_i(x_i)=\mathrm{Sigm}(u_i x_i+v_i) \tag{12}$$

As described above, the scoring unit 105 finds the S(n,k) which indicates the tonal component likeness of each peak by using Equation (11). In addition, the scoring unit 105 sets the score S(n,k) in the position (n,k) having no peak to zero. The scoring unit 105 obtains the score S(n,k) indicating the tonal component likeness at each of the times and frequencies of the time-frequency signal f(n,k). The score S(n,k) takes a value between 0 and 1. Then, the scoring unit 105 outputs the obtained score S(n,k) as tonal component detection results.

Moreover, in the case where it is necessary to make a binary determination as to whether it is a tonal component or not, the determination can be made using an appropriate threshold $S_{Thsd}$ as given in the following Equation (13).

$$\left.\begin{array}{l} S(n,k) \geq S_{Thsd} \rightarrow \text{It is tonal component} \\ S(n,k) < S_{Thsd} \rightarrow \text{It is not tonal component} \end{array}\right\} \tag{13}$$

The operation of the tonal component detection apparatus 100 shown in FIG. 1 will now be described. An input time signal f(t) such as voice or music is supplied to the time-frequency transformation unit 101. The time-frequency transformation unit 101 transforms the input time signal f(t) into a time-frequency representation to obtain a time-frequency signal F(n,k). The time-frequency signal F(n,k) indicates a logarithmic amplitude value of frequency component in the time frame n and frequency k, i.e., it is a spectrogram (time-frequency distribution). This spectrogram is supplied to the peak detection unit 102.

The peak detection unit 102 detects whether peaks are found in the frequency direction at all of the frames and all of the frequencies on the spectrogram. The peak detection results are supplied to the fitting unit 103. The fitting unit 103 fits a tone model in a neighboring region of the peak for each of the peaks. This fitting allows the coefficients of the quadratic polynomial function constituting the tone model (see Equation (4)) to be obtained so that the square error may be minimized. The results obtained by the fitting are supplied to the feature extraction unit 104.

The feature extraction unit 104 extracts a various types of features based on the results (see Equation (6)) obtained by fitting each of the peaks in the fitting unit 103 (see Equation (10)). For example, features such as the curvature of peak, the frequency of peak, the logarithmic amplitude value of peak, the rate of change in amplitude, and the fitting normalization error are extracted. The extracted features are supplied to the scoring unit 105.

The scoring unit 105 obtains the score S(n,k) indicating the tonal component likeness of each of the peaks using the features (see Equation (11)). The score S(n,k) takes a value between 0 and 1. Then, the scoring unit 105 outputs the obtained score S(n,k) as tonal component detection results. In addition, the scoring unit 105 sets the score S(n,k) in the position (n,k) at which there is no peak to zero.

Figure 4:
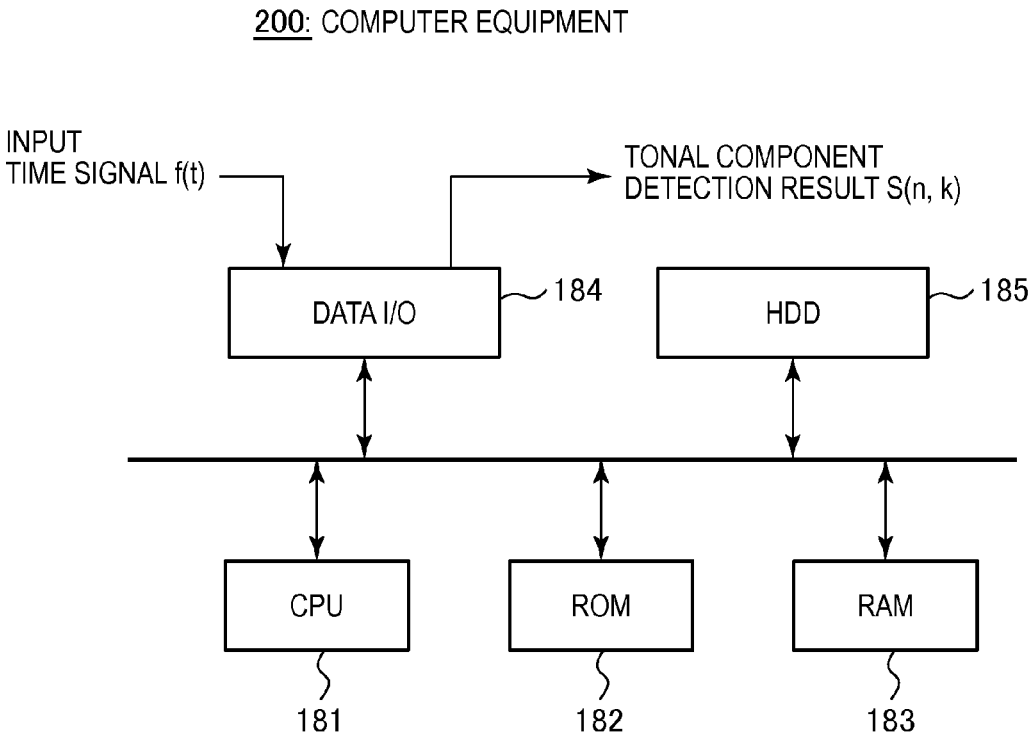
FIG. 4 is a block diagram illustrating an exemplary configuration of computer equipment which performs a tonal component detection process in software.

Furthermore, the tonal component detection apparatus 100 shown in FIG. 1 may be implemented in software as well as hardware. For example, computer equipment 200 shown in FIG. 4 can perform the tonal component detection process similar to that described above by causing the computer equipment to perform functions of the respective portions of the tonal component detection apparatus 100 shown in FIG. 1.

The computer equipment 200 includes a CPU (Central Processing Unit) 181, a ROM (Read Only Memory) 182, a RAM (random Access Memory) 183, a data input/output unit (data I/O) 184, and a mHDD (Hard Disk Drive) 185. The ROM 182 stores the processing programs to be performed by the CPU 181. The RAM 181 serves as a work area for the CPU 181. The CPU 181 reads out the processing programs stored in the ROM 182 as necessary, and sends the readout processing programs to the RAM 183, so that the processing program is loaded in the RAM 183. Thereafter, the CPU 181 reads out the loaded programs to execute the tonal component detection process.

The computer equipment 200 receives an input time signal f(t) through the data I/O 184 and accumulates it to the HDD 185. The CPU 181 performs the tonal component detection process on the input time signal f(t) accumulated in the HDD 185. The tonal component detection result S(n,k) is outputted to outside through the data I/O 184.

Figure 5:
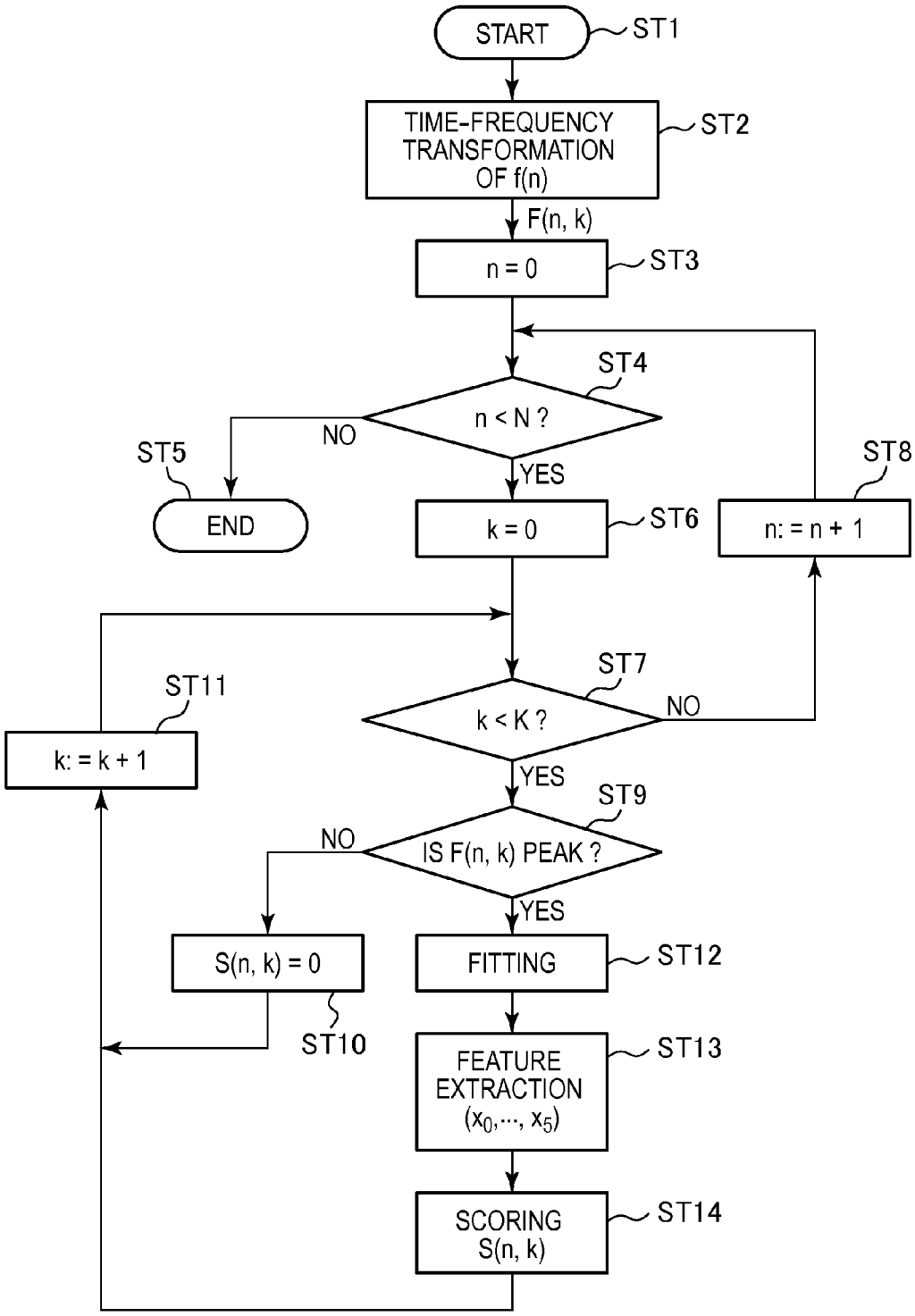
FIG. 5 is a flowchart illustrating an exemplary procedure of the tonal component detection process performed by a CPU of the computer equipment.

The flowchart of FIG. 5 shows an exemplary procedure of the tonal component detection process performed by the CPU 181. In step ST1, the CPU 181 starts the process, and then the process proceeds to step ST2. In the step ST2, the CPU 181 transforms the input time signal f(t) into a time-frequency representation to obtain a time-frequency signal F(n,k), i.e. a spectrogram (time-frequency distribution).

Subsequently, in step ST3, the CPU 181 sets the number n of the frame (time frame) to zero. Then, in step ST4, the CPU 181 determines whether n<N. In addition, frames in the spectrogram (time-frequency distribution) are assumed to be between 0 and N−1. If it is determined that n is greater than or equal to N (n≥N), then the CPU 181 determines that processes for all of the frames are completed, and terminates the process at step ST5.

If it is determined that n is less than N (n<N), then the CPU 181, in step ST6, sets the discrete frequency k to zero. In step ST7, the CPU 181 determines whether k<K. In addition, the discrete frequency k of the spectrogram (time-frequency distribution) is assumed to be between 0 and K−1. If it is determined that k is greater than or equal to K (k≥K), then the CPU 181 determines that processes for all of the discrete frequencies are completed, and, in step ST8, increments the n by 1. Subsequently, the flow returns to step ST4, and then a process for the next frame is performed.

If it is determined that k is less than K (k<K), then the CPU 181, in step ST9, determines whether the F(n,k) is a peak. If the F(n,k) is not a peak, then the CPU 181, in step ST10, sets the score S(n,k) to zero, and then, in step ST11, increments the k by 1. Subsequently, the flow returns to step ST7, and then a process for the next discrete frequency is performed.

In step ST9, if it is determined that the F(n,k) is a peak, then the CPU 181 performs a process of step ST12. In step ST12, the CPU 181 performs a fitting on a tone model in a neighboring region of the peak. The CPU 181, in step ST13, extracts a various types of features ($x_0$, $x_1$, $x_2$, $x_3$, $x_4$, $x_5$) based on the results obtained by the fitting.

Subsequently, the CPU 181, in step ST14, obtains the score S(n,k) indicating the tonal component likeness of each of the peaks using the features extracted in step ST13. The score S(n,k) takes a value between 0 and 1. After step ST14 is completed, the CPU 181 increments the k by 1 at step ST11. Then, the flow returns to step ST7, and then a process for the next discrete frequency is performed.

As described above, the tonal component detection apparatus 100 shown in FIG. 1 performs a fitting on a tonal mode at a neighboring region of each peak in the frequency direction detected from the time-frequency distribution (spectrogram) F(n,k), and obtains a score S(n,k) indicating the tonal component likeness of each peak based on the results obtained by the fitting. Therefore, the tonal components can be detected accurately. Thus, useful information for many application techniques such as voice analysis, coding, noise reduction, and high-quality sound reproduction can be obtained.

Figure 6:
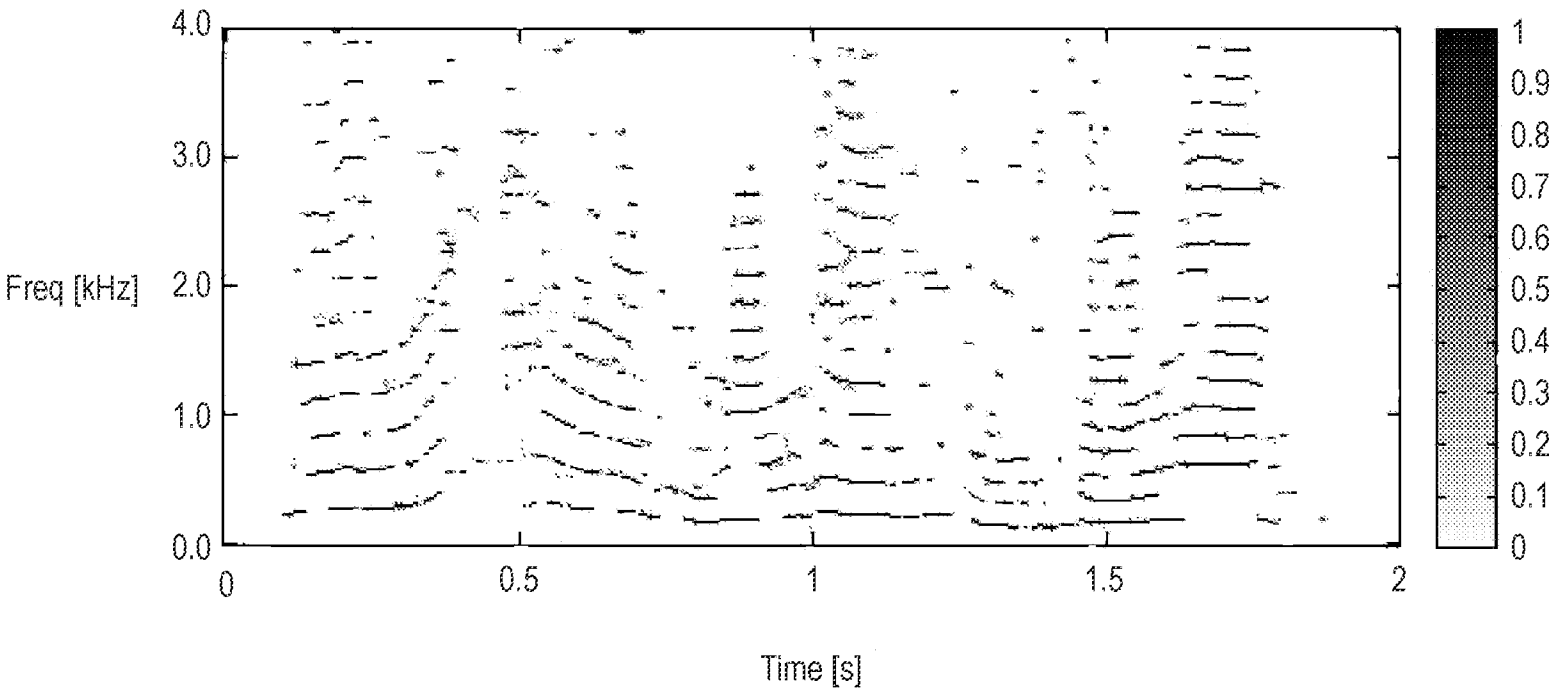
FIG. 6 is a diagram illustrating an example of a tonal component detection result to explain advantageous effects obtainable from an embodiment of the present technology.
Figure 7:
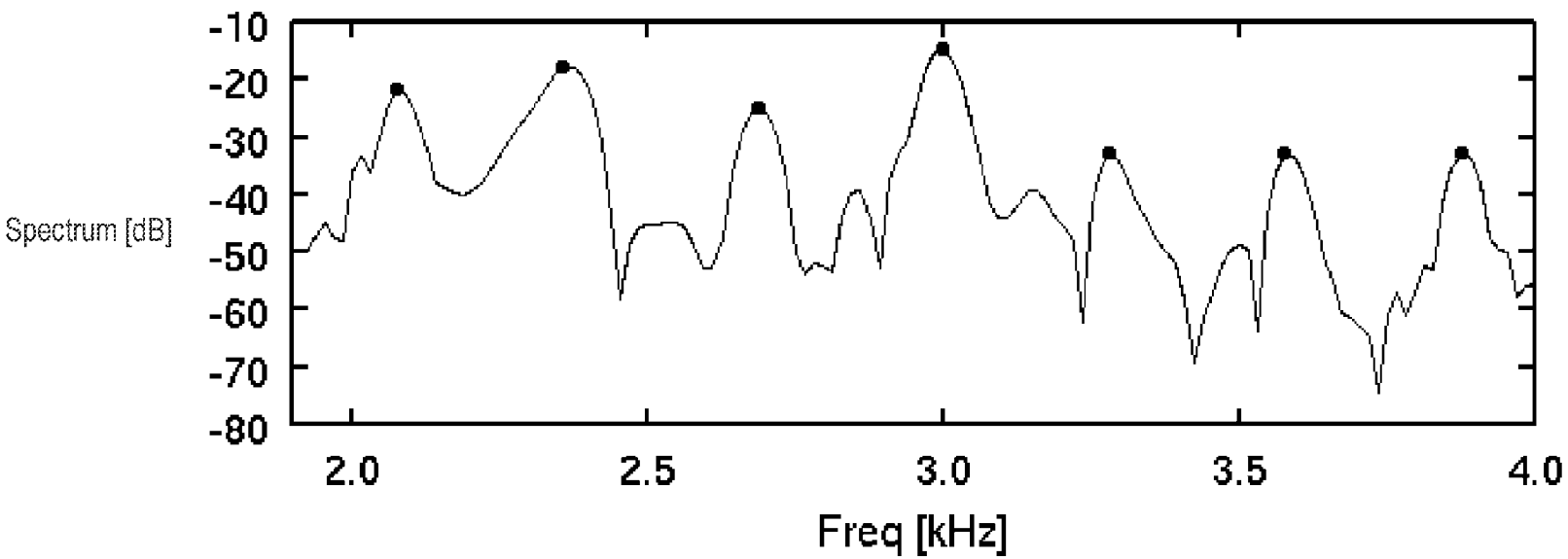
FIG. 7 is a diagram illustrating an example of a tonal component detection result to explain advantageous effects obtainable from an embodiment of the present technology.
Figure 8:
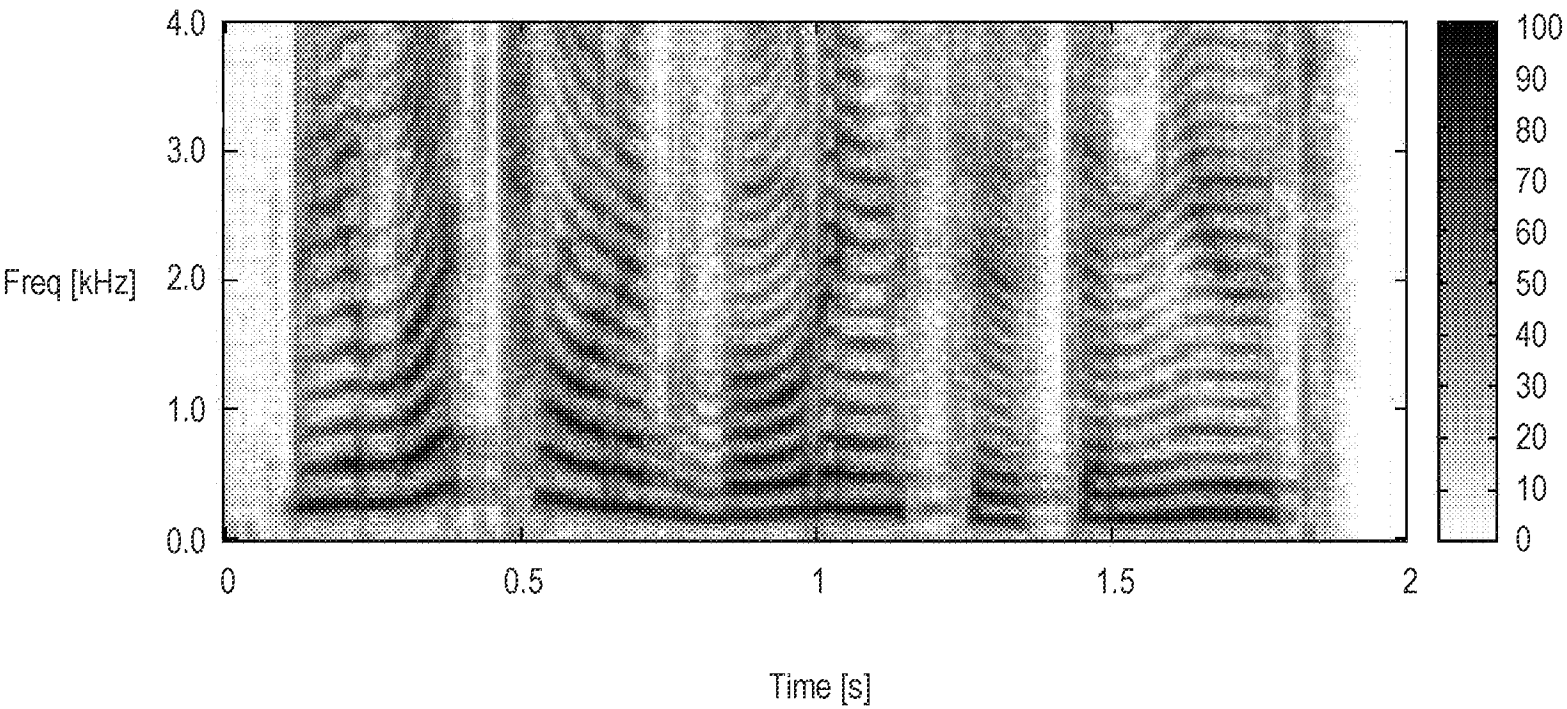
FIG. 8 is a diagram illustrating an example of a voice spectrogram.
Figure 9:
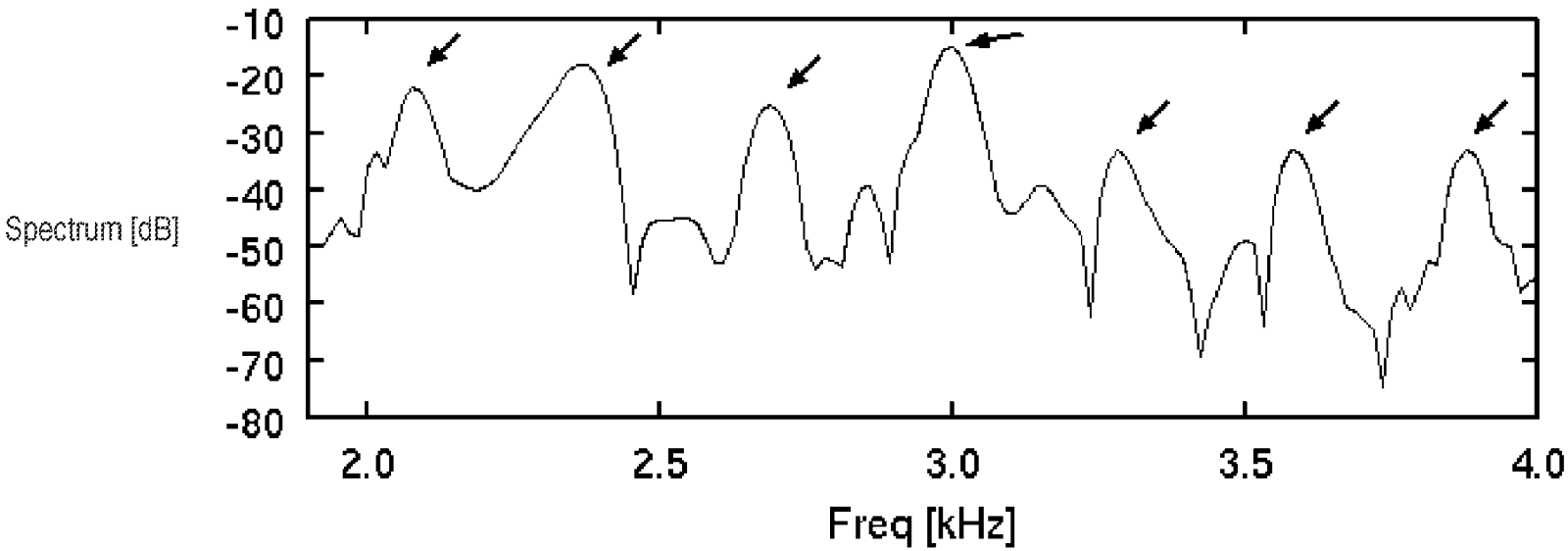
FIG. 9 is a diagram illustrating a spectrum in which predetermined time frames of the spectrogram are extracted.
Figure 10:
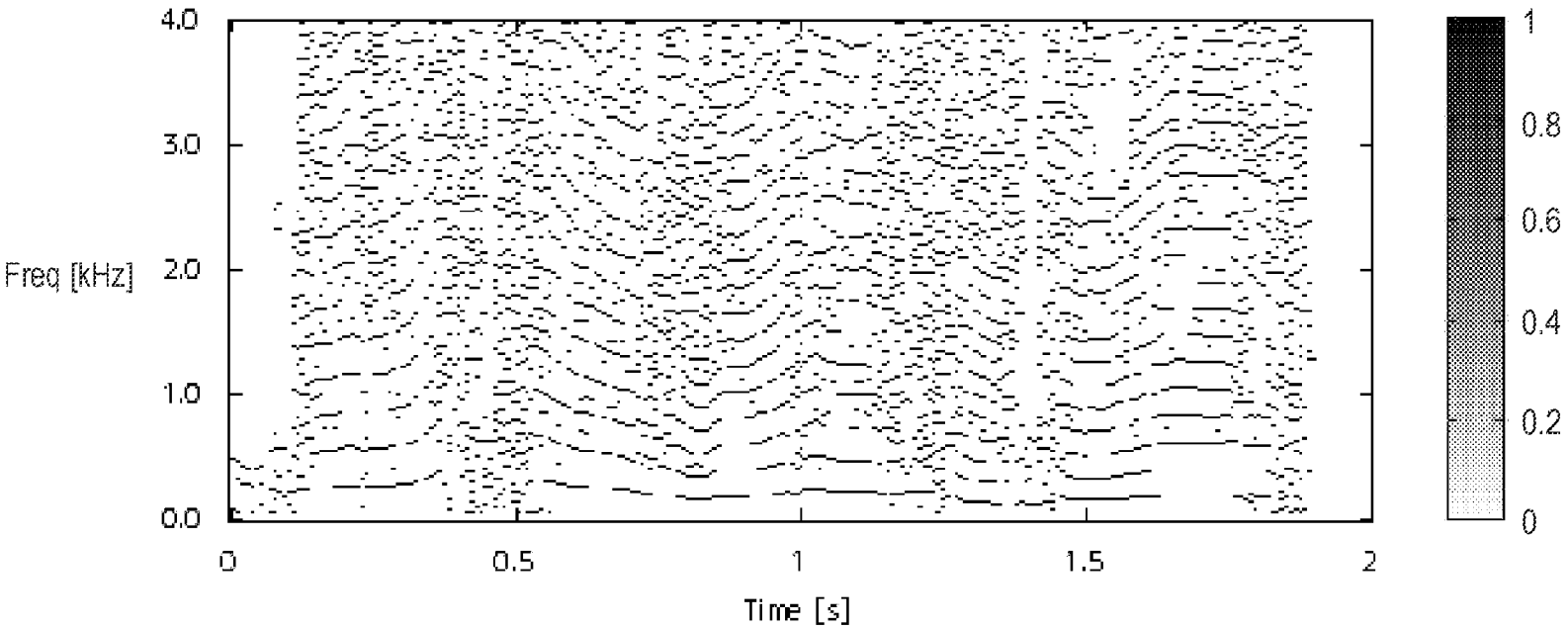
FIG. 10 is a diagram illustrating results obtained by detecting local peaks in amplitude spectrum of each frame on the spectrogram and representing the results by black dots.
Figure 11:
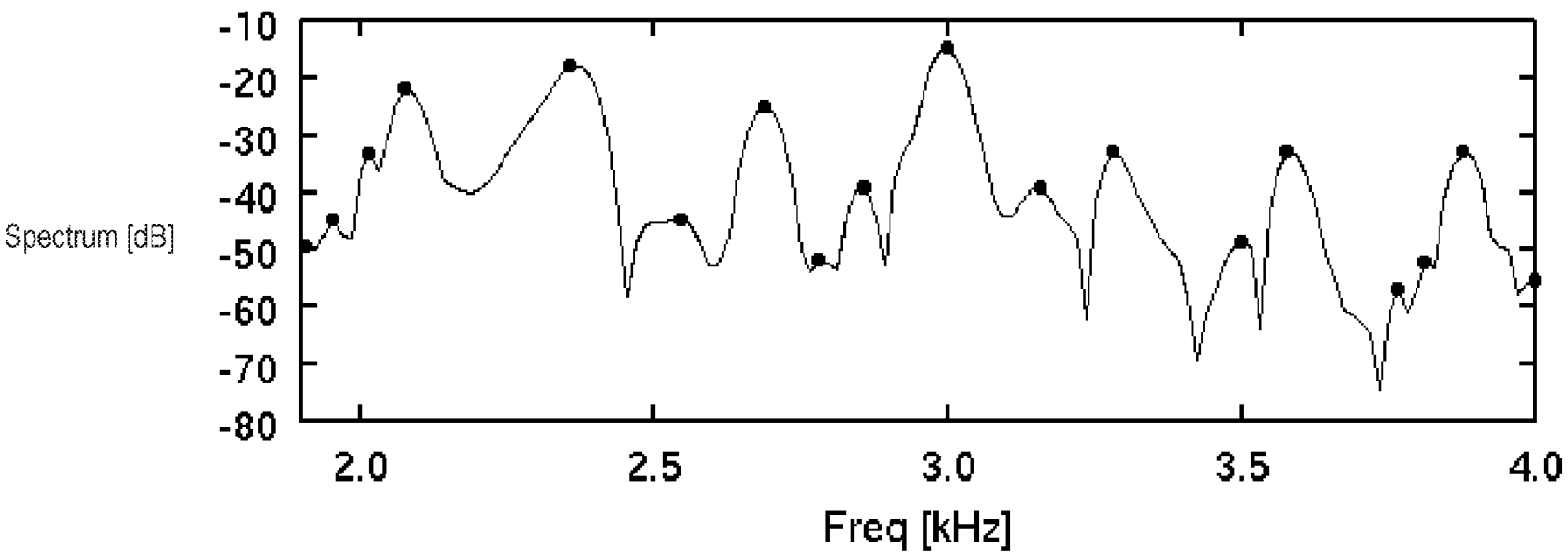
FIG. 11 is a diagram illustrating results obtained by detecting local peaks on the spectrum in which a predetermined time frame of the spectrogram is extracted.

FIG. 6 illustrates an example of the score S(n,k) indicating the tonal component likeness detected using the method according to the embodiment of the present technology from the input time signal f(t) by which the spectrogram as shown in FIG. 8 is obtained. The darker color is displayed as the magnitude of the score S(n,k) becomes larger, thus it will be found that noise peaks are not generally detected, but the peaks of tonal component (component drawn with thick black horizontal lines in FIG. 8) are generally detected. In addition, FIG. 7 illustrates results obtained by detecting the tonal components for the spectrum of FIG. 9. Many non-tonal peaks are erroneously detected by using the methods of FIGS. 10 and 11. However, the tonal peaks can be accurately detected by the method according to the embodiment of the present technology.

Moreover, the tonal component detection apparatus 100 shown in FIG. 1 can also detect the properties such as a curvature of peak, accurate frequency, accurate amplitude value of peak, rate of change in frequency, and rate of change in amplitude in each time of each tonal component (see Equation (10)). These properties are useful for application techniques such as voice analysis, coding, noise reduction, and high-quality sound reproduction.

2. Modification

Although the time-frequency transformation performed using the short-time Fourier transform has been described in the above embodiments, it can be considered that the input time signal is transformed into a time-frequency representation using other transformation techniques such as the wavelet transform. In addition, although the fitting performed using the least square error criterion of the tone model and the time-frequency distribution in the vicinity of each of the detected peaks has been described in the above embodiments, it can be considered that the fitting can be performed using the minimum fourth-power error criterion, the minimum entropy criterion, and so on.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1) A tonal component detection method including:

performing a time-frequency transformation on an input time signal to obtain a time-frequency distribution;

detecting a peak in a frequency direction at a time frame of the time-frequency distribution;

fitting a tone model in a neighboring region of the detected peak; and obtaining a score indicating tonal component likeness of the detected peak based on a result obtained by the fitting.

(2) The tonal component detection method according to (1), wherein, in the step of performing the time-frequency transformation, the time-frequency transformation is performed on the input time signal using a short-time Fourier transform.

(3) The tonal component detection method according to (1) or (2), wherein, in the step of fitting the tone model, a quadratic polynomial function in which a time and a frequency are set as variables is used as the tone model.

(4) The tonal component detection method according to any one of (1) to (3), wherein, in the step of fitting the tone model, the fitting is performed based on a time-frequency distribution in a vicinity of the detected peak and a least square error criterion of the tone model.

(5) The tonal component detection method according to any one of (1) to (4), wherein, in the step of obtaining the score, the score indicating the tonal component likeness of the detected peak is obtained using at least a fitting error extracted based on the result obtained by the fitting.

(6) The tonal component detection method according to any one of (1) to (4), wherein, in the step of obtaining the score, the score indicating the tonal component likeness of the detected peak is obtained using at least a peak curvature in a frequency direction extracted based on the result obtained by the fitting.

(7) The tonal component detection method according to any one of (1) to (4), wherein, in the step of obtaining the score, the score indicating the tonal component likeness of the detected peak is obtained by extracting a predetermined number of features and by combining the predetermined number of extracted features, based on the result obtained by the fitting.

(8) The tonal component detection method according to (7), wherein, in the step of obtaining the score, when the predetermined number of extracted features are combined, a non-linear function is applied to the predetermined number of extracted features to obtain a weighted sum.

(9) The tonal component detection method according to (7) or (8), wherein the predetermined number of features is at least one of a fitting error, a peak curvature in a frequency direction, a frequency of a peak, an amplitude value in a peak position, a rate of a change in a frequency, or a rate of a change in amplitude that are obtained by the tone model on which the fitting is performed.

(10) A tonal component detection apparatus, including:

a time-frequency transformation unit configured to perform a time-frequency transformation on an input time signal to obtain a time-frequency distribution;

a peak detection unit configured to detect a peak in a frequency direction at a time frame of the time-frequency distribution;

a fitting unit configured to perform fitting on a tone model in a neighboring region of the detected peak; and a scoring unit configured to obtain a score indicating tonal component likeness of the detected peak based on a result obtained by the fitting.

(11) A program for causing a computer to function as:

means for performing a time-frequency transformation on an input time signal to obtain a time-frequency distribution;

means for detecting a peak in a frequency direction at a time frame of the time-frequency distribution;

means for fitting a tone model in a neighboring region of the detected peak; and means for obtaining a score indicating tonal component likeness of the detected peak based on a result obtained by the fitting.

The present disclosure contains subject matter related to that disclosed in Japanese Priority Patent Application JP 2012-078320 filed in the Japan Patent Office on Mar. 29, 2012, the entire content of which is hereby incorporated by reference.

What is claimed is:

1. A tonal component detection method comprising:

performing a time-frequency transformation on an input time signal to obtain a time-frequency distribution;

detecting a peak in a frequency direction at a time frame of the time-frequency distribution;

fitting a tone model in a neighboring region of the detected peak; and obtaining a score indicating tonal component likeness of the detected peak based on a result obtained by the fitting.

2. The tonal component detection method according to claim 1, wherein, in the step of performing the time-frequency transformation, the time-frequency transformation is performed on the input time signal using a short-time Fourier transform.

3. The tonal component detection method according to claim 1, wherein, in the step of fitting the tone model, a quadratic polynomial function in which a time and a frequency are set as variables is used as the tone model.

4. The tonal component detection method according to claim 1, wherein, in the step of fitting the tone model, the fitting is performed based on a time-frequency distribution in a vicinity of the detected peak and a least square error criterion of the tone model.

5. The tonal component detection method according to claim 1, wherein, in the step of obtaining the score, the score indicating the tonal component likeness of the detected peak is obtained using at least a fitting error extracted based on the result obtained by the fitting.

6. The tonal component detection method according to claim 1, wherein, in the step of obtaining the score, the score indicating the tonal component likeness of the detected peak is obtained using at least a peak curvature in a frequency direction extracted based on the result obtained by the fitting.

7. The tonal component detection method according to claim 1, wherein, in the step of obtaining the score, the score indicating the tonal component likeness of the detected peak is obtained by extracting a predetermined number of features and by combining the predetermined number of extracted features, based on the result obtained by the fitting.

8. The tonal component detection method according to claim 7, wherein, in the step of obtaining the score, when the predetermined number of extracted features are combined, a non-linear function is applied to the predetermined number of extracted features to obtain a weighted sum.

9. The tonal component detection method according to claim 7, wherein the predetermined number of features is at least one of a fitting error, a peak curvature in a frequency direction, a frequency of a peak, an amplitude value in a peak position, a rate of a change in a frequency, or a rate of a change in amplitude that are obtained by the tone model on which the fitting is performed.

10. A tonal component detection apparatus, comprising:

a time-frequency transformation unit configured to perform a time-frequency transformation on an input time signal to obtain a time-frequency distribution;

a peak detection unit configured to detect a peak in a frequency direction at a time frame of the time-frequency distribution;

a fitting unit configured to perform fitting on a tone model in a neighboring region of the detected peak; and a scoring unit configured to obtain a score indicating tonal component likeness of the detected peak based on a result obtained by the fitting.

11. A program for causing a computer to function as:

means for performing a time-frequency transformation on an input time signal to obtain a time-frequency distribution;

means for detecting a peak in a frequency direction at a time frame of the time-frequency distribution;

means for fitting a tone model in a neighboring region of the detected peak; and means for obtaining a score indicating tonal component likeness of the detected peak based on a result obtained by the fitting.

* * * * *